US007360342B2

(12) United States Patent
Hayes et al.

(10) Patent No.: US 7,360,342 B2
(45) Date of Patent: Apr. 22, 2008

(54) ANCHOR WEDGE FOR POST TENSION ANCHOR SYSTEM AND ANCHOR SYSTEM MADE THEREWITH

(75) Inventors: Norris O. Hayes, Stafford, TX (US); Randy Draginis, Terrell, TX (US)

(73) Assignee: Hayes Specialty Machining, Ltd., Sugar Land, TX (US)

( * ) Notice: Subject to any disclaimer, the term of this patent is extended or adjusted under 35 U.S.C. 154(b) by 331 days.

(21) Appl. No.: 10/878,340

(22) Filed: Jun. 28, 2004

(65) Prior Publication Data

US 2005/0284049 A1 Dec. 29, 2005

(51) Int. Cl.
*E04C 5/08* (2006.01)
*E04C 3/10* (2006.01)

(52) U.S. Cl. ..... 52/223.14; 52/223.13; 52/223.4

(58) Field of Classification Search ..... 52/223.1, 52/223.4, 223.13, 223.14; 24/122.6
See application file for complete search history.

(56) References Cited

U.S. PATENT DOCUMENTS 2,562,658 A * 7/1951 Bonebrake ..... 242/573.6
3,194,080 A * 7/1965 Olson ..... 74/10.7
3,522,682 A * 8/1970 Richmond et al. ..... 52/223.13
3,588,045 A * 6/1971 Stubbs ..... 254/29 A
3,605,361 A * 9/1971 Howlett et al. ..... 52/223.13
3,698,745 A * 10/1972 Mundt ..... 285/256
5,230,537 A * 7/1993 Newman ..... 285/112
5,441,487 A * 8/1995 Vedder ..... 604/167.03
6,322,091 B1 * 11/2001 Lindley ..... 280/149.2
6,817,148 B1 * 11/2004 Sorkin ..... 52/223.13
2006/0117683 A1 * 6/2006 Hayes et al. ..... 52/223.13
2006/0179742 A1 * 8/2006 Mathews et al. ..... 52/223.13

* cited by examiner

*Primary Examiner*—Jeanette Chapman
(74) *Attorney, Agent, or Firm*—Richard A. Fagin

(57) ABSTRACT

A wedge for an anchor system is disclosed. One embodiment of the wedge includes at least two circumferential wedge segments. Each segment defines an exterior tapered surface and an interior surface. The interior surface has gripping elements thereon. The gripping elements define a difference between a major diameter and a minor diameter of about 0.25 to 0.75 of an amount of a difference defined by a conventional thread having substantially a same axial spacing and major diameter as the gripping elements on the interior surface. Another embodiment of the wedge has an interior surface shaped to substantially conform to an exterior surface of a tendon.

21 Claims, 4 Drawing Sheets

ANCHOR WEDGE FOR POST TENSION ANCHOR SYSTEM AND ANCHOR SYSTEM MADE THEREWITH

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of post tension systems for reinforcing concrete structures. More particularly, the invention relates to anchors for post tension cables.

2. Background Art

For quite some time, the design of concrete structures imitated typical steel structure designs of columns, girders and beams. With technological advances in structural concrete, however, designs specific to concrete structures began to evolve. Concrete has several advantages with respect to steel, including lower cost, not requiring fireproofing, and having plasticity, a quality that lends itself to free flowing or boldly massive architectural concepts. On the other hand, structural concrete, though quite capable of carrying almost any compressive (vertical) load, is essentially unable to carry significant tensile loads. In order to enable concrete structures to carry tensile loads, it is necessary, therefore, to add steel bars, called reinforcements, to the concrete. The reinforcements enable the concrete to carry the compressive loads and the steel to carry the tensile (horizontal) loads.

Structures made from reinforced concrete may be built with load-bearing walls, but this configuration does not use the full potential of the concrete. The skeleton frame, in which the floors and roofs rest directly on exterior and interior reinforced-concrete columns, has proven to be most economical and popular method of building concrete structures. Reinforced-concrete framing appears to be a quite simple form of construction. First, wood or steel forms are constructed in the sizes, positions, and shapes called for by engineering and design requirements. Steel reinforcing is then placed and held in position by wires at its intersections. Devices known as chairs and spacers are used to keep the reinforcing bars apart and raised off the form work. The size and number of the steel bars depends upon the imposed loads and the need to transfer these loads evenly throughout the building and down to the foundation. After the reinforcing is set in place, the concrete, a mixture of water, cement, sand, and stone or aggregate, of proportions calculated to produce the required compressive strength, is placed, care being taken to prevent voids or honeycombs.

One of the simplest designs for concrete frames is the beam-and-slab. The beam and slab system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be used over and over for the same shape. The beam and slab system, therefore, produces an economically advantageous structure.

With the development of flat-slab construction, exposed beams can be eliminated. In the flat slab system, reinforcing bars are projected at right angles and in two directions from every column supporting flat slabs spanning twelve or fifteen feet in both directions. Reinforced concrete reaches its highest potentialities when it is used in pre-stressed or post-tensioned members. Spans as great as 100 feet can be attained in members as deep as three feet for roof loads. The basic principle is simple. In pre-stressing, reinforcing rods of high tensile strength steel are stretched to a certain determined limit and then high-strength concrete is placed around them. When the concrete has set, it holds the steel in a tight grip, preventing slippage or sagging. Post-tensioning follows the same principle, but the reinforcing is held loosely in place while the concrete is placed around it. The reinforcing is then stretched by hydraulic jacks and securely anchored into place. Prestressing is performed with individual members in the shop and post-tensioning is performed as part of the structure on the construction site. In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

One such post tensioning system is described in U.S. Pat. No. 3,937,607 issued to Rodormer. The general principle is explained with respect to FIG. 3 in the '607patent and states, in relevant part, "[i]n accordance with conventional techniques, a center hole electro-hydraulic jack is placed on each tendon to tension the tendon. When the jack is released the live end anchor chuck 40 will set and grip the tendon holding the latter at the desired tension." The chuck, or retaining wedge, known in the art is typically a conical-exterior shaped insert which fits in a mating, tapered opening in an anchor plate. The chuck or wedge may be divided into two or more circumferential segments to enable application to the exterior of the tendon or cable prior to insertion into the opening in the anchor plate. The interior opening of the chuck typically includes conventional buttress threads in order to deform and thus grip the exterior surface of the tendon or cable, such that when the jack or tensioning device is released, the tension in the tendon will be transferred to the chuck, and thus to the anchor plate.

Recently, certification procedures for the tensile strength of post tensioning devices promulgated by the American Society for Testing and Materials (ASTM) were amended to provide a standard for the absolute ultimate tensile strength (AUTS) of post tensioning devices. As a result of the new certification procedures, it has been determined that post tensioning devices made using tendon steel compositions and configurations known in the art fail certification testing in a substantial number of cases. The steel alloys used in post tensioning devices are already developed to such an extent that improving the tensile strength of the tendons themselves would be difficult and expensive. Accordingly, there is a need for a configuration of a post tensioning anchor system which has improved tensile strength using materials known in the art, and while maintaining the dimensions of post tensioning anchor systems known in the art.

SUMMARY OF THE INVENTION

One aspect of the invention is a wedge for a reinforcing anchor is disclosed. The wedge includes at least two circumferential wedge segments. Each segment defines an exterior tapered surface and an interior surface. The interior surface has gripping elements thereon. The gripping elements define a difference between a major diameter and a minor diameter of about 0.25 to 0.75 of an amount of a difference defined by a conventional thread having substantially a same pitch and major diameter as the gripping elements on the interior surface. In one embodiment, the gripping elements comprise threads. In another embodiment, the gripping elements are substantially coaxial and perpendicular to the longitudinal axis of the wedge.

Another aspect of the invention is a wedge for a reinforcement anchoring system. A wedge according to this aspect includes at least two circumferential wedge segments. Each segment defines an exterior tapered surface and an interior surface. The interior surface is shaped to substantially conform to an exterior surface of a tendon.

Another aspect of the invention is a reinforcing system. A system according to this aspect includes an anchor plate having at least one generally tapered receiving bore therein. The system includes at least two circumferential wedge segments, each segment defining an exterior tapered surface and an interior surface. The interior surface has gripping elements adapted to grip a reinforcing tendon. The exterior surface is tapered so as to engage cooperatively with a corresponding taper in the receiving bore. The wedge segments define a wedge when applied to the exterior surface of the tendon. The bore in the anchor plate defines a minimum internal diameter at least as large as a minimum compressed external diameter of the wedge.

Other aspects and advantages of the invention will be apparent from the following description and the appended claims.

DETAILED DESCRIPTION

Figure 1:
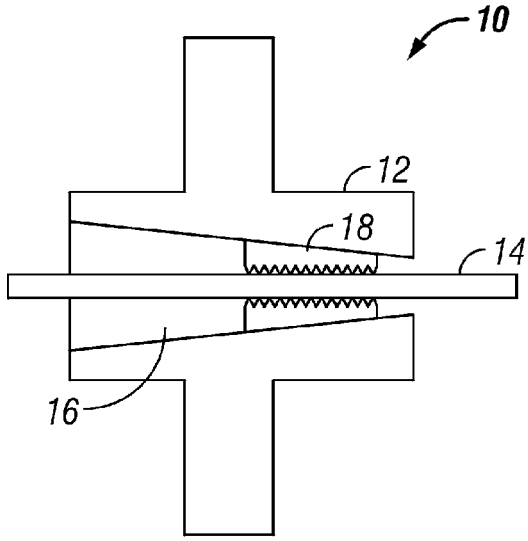
FIG. 1 shows an embodiment of an assembled post tension anchor and tendon.

An assembled post tensioning anchor system and tendon are shown generally in cross section in FIG. 1. The anchor system 10 includes an anchor plate 12, usually cast or forged from a malleable metal. The anchor plate 12 is adapted to be cast into or otherwise affixed to a concrete member (not shown in FIG. 1) that is to be reinforced using the tendon and anchor system therefore according to the invention. The anchor plate 12 includes a generally conically-shaped receiving bore 16 for receiving and holding an anchor wedge 18. The anchor wedge 18 may be formed from two or more circumferential segments, as will be explained below with reference to FIGS. 3, 3A and 3B, and includes inwardly projecting gripping elements to penetrate and grip the outer surface of a reinforcing tendon 14. As axial tension is applied to the tendon 14, the conically shaped exterior surface of the wedge 18 and the receiving bore 16 cooperate to laterally squeeze the circumferential segments of the wedge 18 together such that it grips the tendon 14 tightly, thus restraining the tendon 14 from axial movement. In actual use, the tendon 14 is axially stretched, and the wedge 18 is applied to the exterior of the tendon 14. When the tension is released from the tendon 14, the wedge 18 is pulled into the receiving bore 16 on the anchor plate 12. The anchor plate 12 shown in FIG. 1 includes only one receiving bore 16. However, other embodiments of an anchor plate may include any number of such receiving bores. The receiving bore configuration of the anchor 12 plate shown in FIG. 1 is therefore not intended to limit the scope of the invention.

Figure 2:
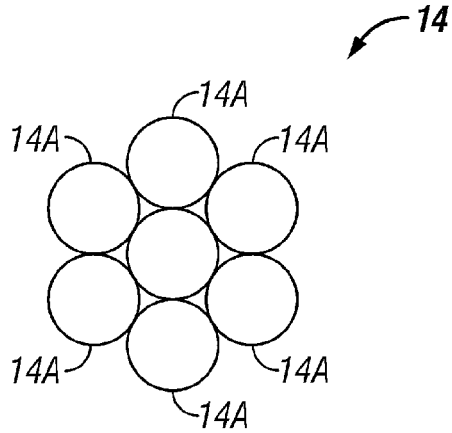
FIG. 2 shows an end view of the tendon shown in FIG. 1.

FIG. 2 shows an end view of a typical tendon 14. The tendon in this example is made from six, high tensile strength steel wires 14A, generally wound in a helical pattern around a centrally positioned, seventh wire 14A. In one embodiment, the wires 14A are made from steel having a tensile strength of 270,000 psi. Typically, the steel from which the wires 14A are made has a surface hardness of about 54 Rockwell "C". The foregoing specifications for the wires 14A are only meant to serve as examples of wires that are used in post tension reinforcement systems, and are not intended to limit the scope of the invention.

Figure 3:
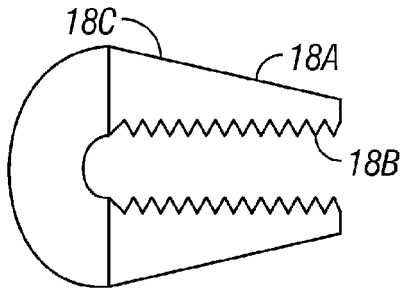
FIG. 3 shows a wedge segment used in the anchor system shown in FIG. 1.

FIG. 3 shows an example of one circumferential segment 18A for the wedge (18 in FIG. 1). In the example of FIG. 3, the wedge is formed from two such circumferential segments 18A, however, the number of such circumferential segments forming any particular embodiment of a wedge is not intended to limit the scope of the invention. The wedge (18 in FIG. 1) is typically formed by casting a single, truncated cone-shaped metal body (not shown in the Figures) from a soft steel alloy. In the presen embodiment, a hole is drilled in the single, cone-shaped metal body (not shown), and then the gripping elements can be formed inside the hole. In the present embodiment, the gripping elements are specially configured threads.

The single, cone shaped metal body (not shown) is then cut into the two or more circumferential segments such as the one shown in FIG. 3 at 18A, resulting in wedge segments 18A having a tapered exterior surface 18C and an interior surface 18B which in the present embodiment is threaded. The taper angle of the exterior surface 18C, and a taper angle of the interior surface 18B will be further explained below with reference to FIG. 4. After forming, the wedge segments 18A are typically case hardened to about 62 Rockwell "C" hardness so that the interior surface 18B can deform the exterior surface of the tendon (14 in FIG. 1) to enable gripping the tendon (14 in FIG. 1) as the wedge is laterally compressed onto the tendon. While steel is typically used to form the wedge, the actual material used for the wedge is not a limitation on the scope of the invention.

Figure 3A:
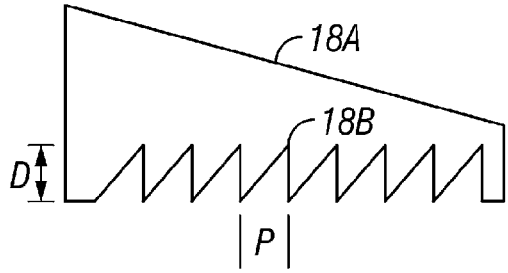
FIG. 3A (Prior Art)
FIG. 3A shows a prior art thread configuration for an anchor wedge.
Figure 3B:
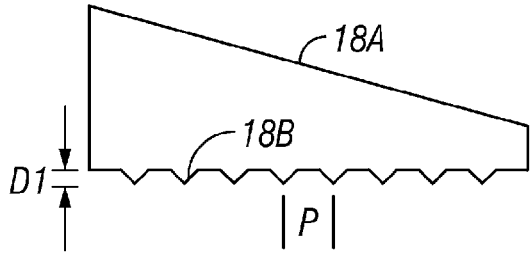
FIG. 3B shows one embodiment of thread in a wedge according to the invention.

One aspect of the invention can be better understood by referring to FIGS. 3A and 3B. FIG. 3A shows a configuration for threads (as the gripping elements) known in the art on a typical wedge segment 18A. The threads known in the art for use on anchor wedges may be so-called "buttress" threads, or may be other industry standard thread types known by designations "UNC" (unified coarse thread) or "UNF" (unified fine thread, also known as Society of Automotive Engineers—SAE thread). The threads are dimensionally defined by pitch P (number of threads per unit length along the longitudinal axis of the threaded element) and a difference, denoted at D between the thread major diameter and thread a minor diameter. Major diameter is the maximum diameter defined at the root (base or bottom of each thread) of the thread and the minor diameter is the minimum diameter defined at the crest of the thread (point or tip of each thread). As an example, the dimension D for threads known in the art used to anchor a 0.5 inch (12.7 mm) diameter tendon (14 in FIG. 1) is about 0.021 inches (0.5 mm). It has been determined through failure analysis of anchor systems tested to the point of tensile failure that a principal source of the failure of the tendon during axial stress testing is a reduction of the effective external diameter of the tendon and the formation of stress risers resulting from relatively deep penetration of the surface of the tendon (14 in FIG. 1) by the threads on the wedge segments 18A.

FIG. 3B shows a wedge having an interior surface 18B formed according to one aspect of the invention. In this aspect, the interior surface 18B is formed so as to have threads which define substantially the same minimum internal diameter (at the thread crests) as in the prior art example of FIG. 3A. The pitch P can also be the same as for the prior art thread. However, the maximum diameter defined by the thread roots is limited such that the diameter difference, denoted as D1 in FIG. 3B, is limited to about 0.25 to 0.75 of the difference of UNC, UNF, buttress or similar "full depth" threads (defined herein as "conventional" thread) known in the art. Limiting the difference D1 to the suggested range of equivalent conventional threads will effectively limit the penetration by the threads into the surface of the tendon (14 in FIG. 1) so as to reduce the incidence of tendon failure under axial loading.

The foregoing embodiment of the invention includes threads as the gripping elements, because threading is a convenient way to form the gripping elements needed to penetrate the exterior surface of the tendon. In other embodiments, the wedge segments may be formed, for example, from powdered metallurgy processes, and the gripping elements needed to penetrate the exterior surface of the tendon may be formed directly into the interior surface of the segments without threading. In such embodiments, the interior surface may be formed so as to have the gripping elements correspond in shape to the threads explained with reference to FIG. 3B. Because the gripping elements need not be formed with a thread tap, however, the gripping elements may traverse the inner surface of the wedge segments in a direction substantially perpendicular to the longitudinal axis of the wedge (being thus substantially coaxial with the wedge), rather than being helically wound around the longitudinal axis. The geometry of such gripping elements may be defined with respect to a major and a minor diameter in substantially the same way as the thread embodiment explained with reference to FIG. 3B, namely that the difference between the major and the minor diameter defined by the gripping elements is between about 0.25 and 0.75 of the difference between the major and minor diameter of a conventional thread having a pitch and minor diameter substantially equal to the corresponding axial spacing and minor diameter of the gripping elements.

It should also be clearly understood that the pitch of the gripping elements, whether they are in the form of threads (helically wound around the longitudinal axis) or perpendicular to the wedge axis, need not be constant over the entire axial length of the wedge. Variable pitch may be used in some embodiments without departing from the scope of the invention.

Figure 4:
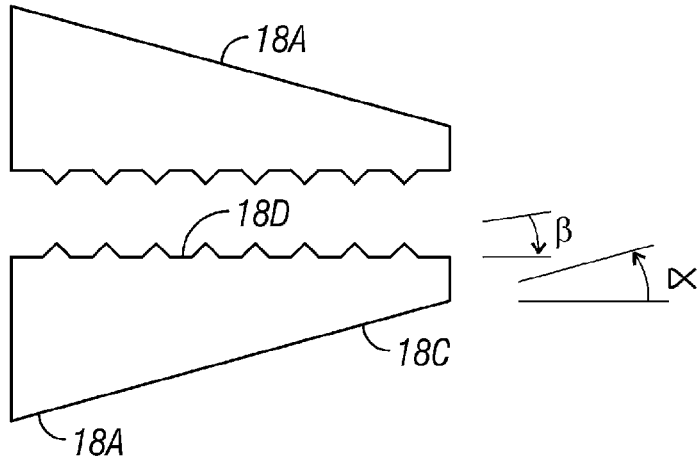
FIG. 4 shows internal and external tapers on a wedge according to another embodiment of the invention.

Another aspect of the invention will now be explained with reference to FIG. 4. As previously explained, the wedge segments 18A have a generally conically shaped exterior surface 18C which engages cooperatively with the similarly shaped receiving bore (16 in FIG. 1) in the anchor plate (12 in FIG. 1). The taper is defined by an angle $\alpha$ subtended between the exterior surface 18C and the longitudinal axis of the wedge segment 18A. In one embodiment, the angle $\alpha$ is selected with respect to the angle (not shown) of the receiving bore (16 in FIG. 1) taper so as to evenly distribute clamping force along the length of the wedge (18 in FIG. 1). Typically, the angle $\alpha$ will be slightly greater than the angle of the receiving bore (16 in FIG. 1) taper so as to distribute the clamping forces evenly. In another embodiment, an angle subtended between the interior surface 18B and the longitudinal axis, shown by $\beta$ in FIG. 4, is selected to evenly distribute the clamping forces along the length of the wedge (18 in FIG. 1). Typically, the angle $\beta$ will be such that the interior surface 18B defines a taper opposite to the taper defined by the exterior surface 18A.

In another aspect, and still referring to FIG. 4, the angle $\beta$ can be selected such that the penetration depth of the threads on the interior surface is substantially the same along the length of the wedge (18 in FIG. 1). It has also been determined by failure analysis of tested tendon anchoring systems that tensile failure tends to occur at the axial position of the first thread on the wedge, first being defined with respect to the narrow end of the taper of the exterior surface 18C. It is believed that the first thread tends to most deeply penetrate the surface of the tendon (14 in FIG. 1) using conventional wedge configurations known in the art. By providing an internal taper as shown in FIG. 4, and having an appropriately selected angle $\beta$, the depth of penetration of the threads into the exterior surface of the tendon (14 in FIG. 1) can be equalized along the length of the wedge, which may reduce the tendency of the tendon (14 in FIG. 1) to fail at the axial position of the first thread on the wedge (18 in FIG. 1).

Figure 5A:
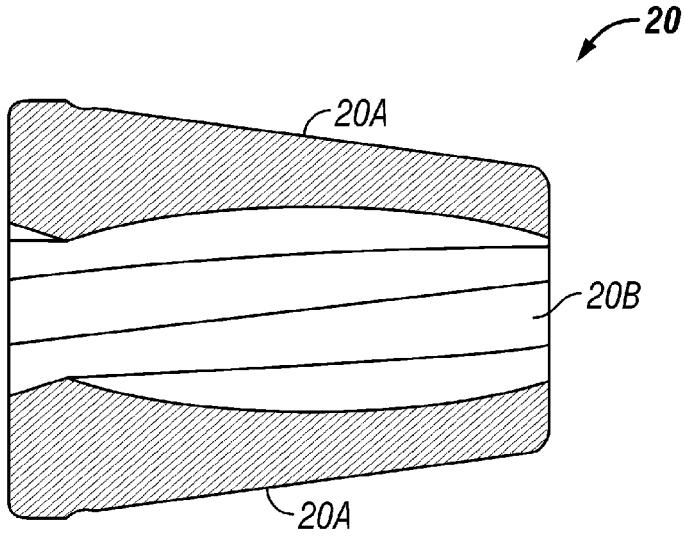
FIGS. 5A, 5B and 5C show another embodiment of a post tension anchor wedge in cross-section, end view and oblique view, respectively.
Figure 5B:
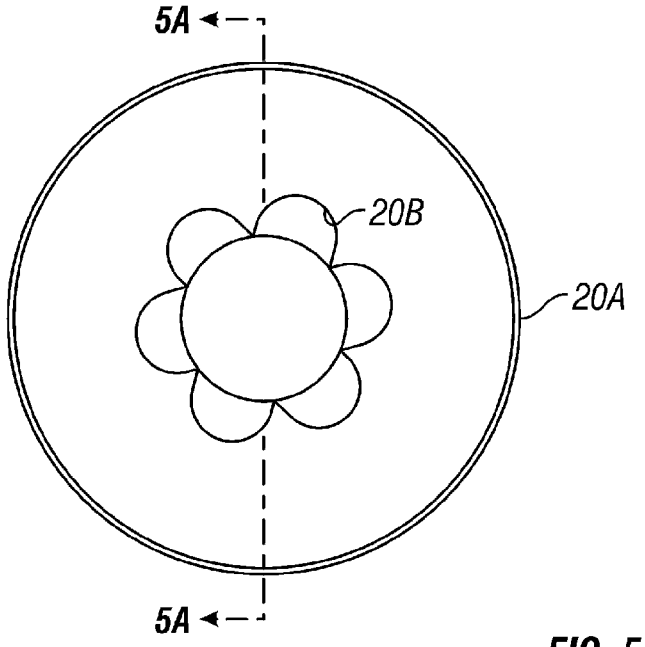
Figure 5C:
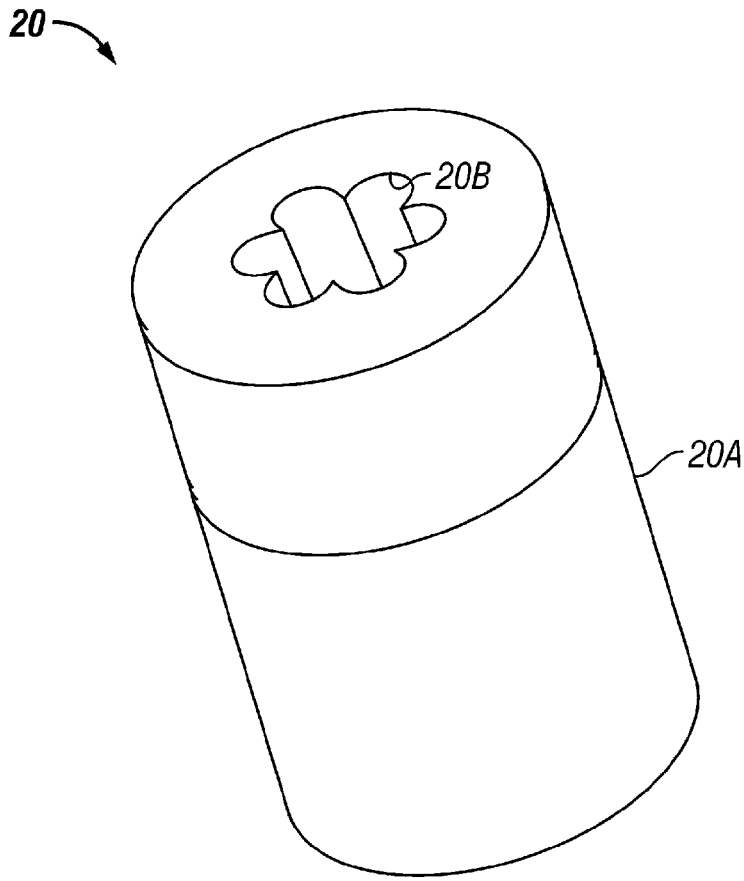

Another embodiment of a wedge is shown in FIGS. 5A, 5B and 5C in cross-section, end view and oblique view, respectively. The wedge 20 may be formed from soft steel alloy as explained with reference to FIG. 1, or from other materials. The wedge 20 in FIGS. 5A, 5B and 5C includes a generally tapered exterior surface 20A which may be formed as explained above with reference to FIGS. 3A, 3B and 4, or may have a taper which substantially matches the taper in the receiving bore (16 in FIG. 1) in the anchor plate (12 in FIG. 1). The inner surface 20B of the wedge 20 may be machined, cast, formed by a powdered metal process, or any other forming techniques known in the art. The inner surface 20B is shaped so as to substantially match the geometry of the exterior surface of the tendon (14 in FIG. 1). The wedge 20 thus can grip the exterior surface of the tendon (14 in FIG. 1) without the need to penetrate or substantially deform the exterior surface of the tendon (14 in FIG. 1). The wedge 20 as shown in FIGS. 5A, 5B and 5C is in a single element, however for use in a post tension anchoring system, the single element may be cut or otherwise separated into two or more circumferential segments, as in the embodiments shown in and explained with reference to FIG. 3B. The tendon (14 in FIG. 1) is typically formed from six individual wires helically wound around a central wire, thus the embodiment shown in FIGS. 5A, 5B and 5C includes a corresponding interior surface 20B on the wedge 20. However, any other shape for the exterior surface of the tendon can be used in other embodiments provided that the interior surface 20B is formed to substantially match it. Preferably such exterior tendon surface is not smooth cylindrical. Preferred shapes for the tendon surface typically have a larger surface area to volume ratio than a plain, smooth cylinder having substantially the same exterior diameter. More typically, the tendon will include one or more central wires and a plurality of wires helically wound around the one or more central wires. Such tendon configurations are expected to perform as explained when used with an embodiment of a wedge formed as explained with reference to FIGS. 5A, 5B and 5C.

As in the previous embodiments, the embodiment shown in FIGS. 5A, 5B and 5C may include a taper on the interior surface, as explained with reference to FIG. 4. The taper in such embodiments subtends an angle with respect to the longitudinal axis of the wedge 20 such that a clamping force applied by the wedge to a tendon disposed therein is substantially evenly distributed along the length of the wedge. Also as in the embodiments explained with reference to FIG. 4, some embodiments of the wedge 20 shown in FIGS. 5A, 5B and SC may provide that the taper angle of the exterior surface 20A is selected with respect to the angle (not shown) of the receiving bore (16 in FIG. 1) taper so as to substantially evenly distribute clamping force along the length of the wedge 20. Typically, the taper angle of the exterior surface 20A will be slightly greater than the taper angle of the receiving bore (16 in FIG. 1) taper so as to distribute the clamping forces evenly along the longitudinal axis of the wedge 20.

Another aspect of the invention will now be explained with reference to FIG. 6. In this aspect of the invention, an anchor for a reinforcement system is formed so as to reduce the possibilities of tendon "pullout", tendon failure or other reinforcement system failure caused by what has been determined to be pinching of the nose end of the wedge upon application of axial stress to the reinforcing tendon using anchors known in the part. The embodiment in FIG. 6 includes a wedge 18 applied to the exterior of a reinforcing tendon 14. The wedge 14 and the tendon may be formed as explained above with reference to FIGS. 1 through 5C, or may be formed as already known in the art. The exterior surface of the wedge 14 is generally tapered, also as previously explained, and is inserted into a generally correspondingly tapered receiving bore 16 on the interior of a reinforcement anchor 12. The taper of the exterior surface of the wedge 14 may be formed as explained above with reference to FIG. 4, or may be formed as already known in the art.

In the present embodiment, when the wedge 14 is seated in the bore 16 by reason of axial tension on the tendon 14, the wedge 18 will be laterally compressed such that gripping elements (18B in FIG. 3) engage the outer surface of the tendon 14 to a selected penetration depth through the tendon 14 outer surface. At the full rated axial tension on the system, the wedge 18 will have a minimum external diameter that is fully compressed, this diameter being shown in FIG. 6 as $D_{comp}$. In the present embodiment, the bore 16 is formed so that its minimum internal diameter, shown at $D_{min}$, is at least as large as the compressed minimum external diameter of the wedge 18. By limiting the minimum internal diameter $D_{min}$ of the bore 16 to be at least as large as the compressed minimum external diameter $D_{comp}$ of the wedge 18, it has been determined that incidence of pinching at the nose end of the wedge 18 can be substantially reduced. Further, it has been determined that by providing the minimum bore diameter as explained above, the exterior surface of the wedge 18 can maintain substantially full contact with the inner surface of the bore 16, and the inner surface of the wedge 18 cam maintain substantially full contact with the exterior surface of the tendon 14.

Figure 6:
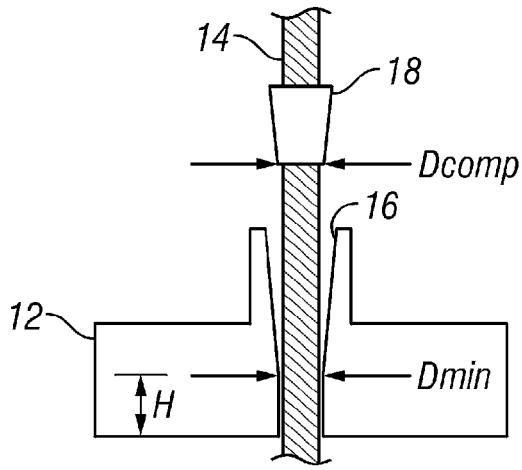
FIG. 6 shows a cut away view of an embodiment including another aspect of the invention.

It has been determined that pinching of the nose of the wedge 18, using prior art anchors where the minimum internal diameter of the bore is not limited as shown in FIG. 6, in addition to causing excessive penetration of the gripping elements through the tendon 14 near the nose end of the wedge 18, can cause the wedge 18 to lose contact with the bore 16 over a substantial portion of its length, thus reducing the effective gripping strength of the wedge 18 to the tendon 14, as well as reducing the effective contact area between the wedge 18 and the tendon 14, thus reducing the pullout strength of the wedge/tendon combination. An anchor having a bore according to the present embodiment has been shown to reduce the foregoing disadvantages of prior art anchors.

Forming the bore 16 to have the stated minimum diameter $D_{min}$ can be performed by appropriate casting techniques, or by machining subsequent to casting. While it is certainly possible to limit the minimum bore diameter by enlarging the overall diameter of the bore at every point along its length, it will be readily appreciated by those skilled in the art that performance of the anchor 12 can be improved by having the minimum diameter $D_{min}$ in the bore 16 start at a selected axial position, shown at h, above the base of the anchor 12. By forming the bore 16 as explained herein, it is less likely that the wedge 18 would be prevented from being fully seated in the bore 16 by the presence of cement or other obstruction in the base of the bore 16 because of the free space provided by having such a clearance length h at the base of the bore 16.

Embodiments of an anchor wedge for a reinforcing system, and anchor systems made with such wedges can provide higher tensile strength to post tension reinforcing tendons.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wedge for a reinforcement system, comprising:

at least two circumferential wedge segments, each segment defining an exterior tapered surface and an interior surface, the interior surface defining a plurality of gripping elements thereon, the gripping elements defining a difference between a major diameter and a minor diameter of about 0.25 to 0.75 of an amount of a difference defined by a conventional thread having substantially a same axial spacing and a same minor diameter as the gripping elements, such that tensile failure of a tendon retained in the wedge by the gripping elements is reduced.

2. The wedge as defined in claim 1 wherein the gripping elements comprise threads.

3. The wedge as defined in claim 1 wherein the gripping elements are substantially coaxial and substantially perpendicular to a longitudinal axis of the wedge.

4. The wedge as defined in claim 1 further comprising a taper on the interior surface, the taper subtending an angle with respect to a longitudinal axis of the wedge such that a clamping force applied by the wedge to a tendon disposed therein is substantially evenly distributed along the length of the wedge.

5. The wedge as defined in claim 1 further comprising a taper on the interior surface, the taper subtending an angle with respect to a longitudinal axis of the wedge such that a depth of penetration of the threads into the exterior surface of a tendon disposed therein is substantially equal along the length of the wedge.

6. The wedge as defined in claim 1 wherein an angle subtended by the exterior surface of the wedge is selected such that when the wedge is cooperatively engaged in a receiving bore in an anchor plate, a clamping force applied by the wedge to a tendon disposed therein is substantially equally distributed along the length of the wedge.

7. A reinforcement system, comprising:

an anchor plate having at least one generally tapered bore therein; and at least two circumferential wedge segments, each segment defining an exterior tapered surface and an interior surface, the exterior surface configured to cooperatively engage with the at least one tapered bore on the anchor plate, the interior surface having gripping elements thereon, the gripping elements defining a difference between a major diameter and a minor diameter of about 0.25 to 0.75 of an amount of a difference defined by a conventional thread having substantially a same axial spacing and minor diameter as the gripping elements, the wedge segments defining a wedge when applied to an exterior surface of a reinforcing tendon, such that tensile failure of a tendon retained in the anchor plate by the gripping elements in the wedge segments is reduced.

8. The system as defined in claim 7 further comprising a taper on the interior surface, the taper subtending an angle with respect to a longitudinal axis of the wedge such that a clamping force applied by the wedge to a tendon disposed therein is substantially evenly distributed along the length of the wedge.

9. The system as defined in claim 7 wherein an angle subtended by the exterior surface of the wedge is selected such that when the wedge is cooperatively engaged in the bore, a clamping force applied by the wedge to a tendon disposed therein is substantially equally distributed along the length of the wedge.

10. The system as defined in claim 7 further comprising a taper on the interior surface, the taper subtending an angle with respect to a longitudinal axis of the wedge such that a depth of penetration of the threads into the exterior surface of a tendon disposed therein is substantially equal along the length of the wedge.

11. The system as defined in claim 7 wherein the gripping elements comprise threads.

12. The system as defined in claim 7 wherein the gripping elements are substantially coaxial and substantially perpendicular to a longitudinal axis of the wedge.

13. The system as defined in claim 7 wherein a minimum diameter of the bore is at least as large as a fully minimum compressed external diameter of the wedge.

14. The system as defined in claim 7 wherein the bore in the anchor plate defines a minimum internal diameter at least as large as a minimum compressed diameter of the wedge.

15. The system as defined in claim 14 wherein the minimum internal diameter is located at a selected position above the base of the anchor plate.

16. A reinforcing system, comprising:

an anchor plate having at least one generally tapered receiving bore therein; and at least two circumferential wedge segments, each segment defining an exterior tapered surface and an interior surface, the interior surface having gripping elements adapted to grip a reinforcing tendon, the exterior surface tapered so as to engage cooperatively with a corresponding taper in the receiving bore, the wedge segments defining a wedge when applied to the exterior surface of the tendon, the bore in the anchor plate defining a minimum internal diameter at least as large as a minimum compressed external diameter of the wedges, such that tensile failure and pullout failure of the tendon are reduced.

17. The system as defined in claim 16 wherein the minimum internal diameter is located at a selected position above the base of the anchor plate.

18. The system as defined in claim 16 wherein an angle subtended by the exterior surface of the wedge is selected such that when the wedge is cooperatively engaged in the receiving bore in the anchor plate, a clamping force applied by the wedge to the tendon disposed therein is substantially equally distributed along the length of the wedge.

19. The system as defined in claim 16 further comprising a taper on the interior surface, the taper subtending an angle with respect to a longitudinal axis of the wedge such that a clamping force applied by the wedge to the tendon disposed therein is substantially evenly distributed along the length of the wedge.

20. The system as defined in claim 16 wherein the gripping elements comprise forming the interior surface of the wedge to substantially conform to an exterior surface of the tendon.

21. The system as defined in claim 16 wherein the gripping elements define a difference between a major diameter and a minor diameter of about 0.25 to 0.75 of an amount of a difference defined by a conventional thread having substantially a same axial spacing and minor diameter as the gripping elements.

* * * * *